US005876229A

United States Patent [19]

Negle

[11] Patent Number: 5,876,229

[45] Date of Patent: Mar. 2, 1999

[54] HIGH-VOLTAGE CONNECTOR

[75] Inventor: Hans Negle, Nahe, Germany

[73] Assignee: U.S. Philips Corporation, New York, N.Y.

[21] Appl. No.: 544,947

[22] Filed: Oct. 18, 1995

[30] Foreign Application Priority Data

Oct. 19, 1994 [DE] Germany ..... 44 37 382.1

[51] Int. Cl.[6] ..... H01R 13/52

[52] U.S. Cl. ..... 439/281

[58] Field of Search ..... 439/199, 200, 439/201, 281, 282, 921, 936

[56] References Cited

U.S. PATENT DOCUMENTS 3,750,088 7/1973 Berian ..... 439/201 OR
3,982,059 9/1976 Holland et al. ..... 439/201 X
5,194,012 3/1993 Cairns ..... 439/201 OR
5,358,419 10/1994 Pejsa et al. ..... 439/201 OR

FOREIGN PATENT DOCUMENTS 0477857 4/1992 European Pat. Off. .
3003166 8/1981 Germany .

*Primary Examiner*—P. Austin Bradley
*Assistant Examiner*—Daniel Wittels
*Attorney, Agent, or Firm*—Dwight H. Renfrew

[57] ABSTRACT

The invention relates to a high-voltage connector, consisting of a plug member and a receptacle member receiving the plug member, the area of the plug member facing the receptacle member and/or the area of the receptacle member facing the plug member being provided with a layer of an elastomer. A particularly high high-voltage strength is achieved in that the elastomer is made to swell by means of a swelling medium. The invention also relates to an X-ray generator comprising such a high-voltage connector and to a method of manufacturing such a high-voltage connector.

9 Claims, 1 Drawing Sheet

HIGH-VOLTAGE CONNECTOR

BACKGROUND OF THE INVENTION

The invention relates to a high-voltage connector, consisting of a plug member and a receptacle member for receiving the plug member, the area of the plug member facing the receptacle member and/or the area of the receptacle member facing the plug member being provided with a layer of an elastomer. The invention also relates to an X-ray generator comprising such a high-voltage connector and to a method of manufacturing such a high-voltage connector.

The high-voltage strength of a high-voltage connector consisting of a plug member and a receptacle member is limited by ionization processes in the joint between the facing surfaces of the plug member and the receptacle member. Therefore, these parts must be sufficiently long to preclude the occurrence of such ionization processes.

FIELD OF THE INVENTION

From DE-PS 30 03 166 it is known that the overall length of such a high-voltage connector can be reduced when a force produced by a spring construction continuously presses the plug member into the receptacle member. However, this spring construction is comparatively complex and itself has a given overall length.

SUMMARY OF THE INVENTION

It is an object of the present invention to provide a high-voltage connector whose high-voltage strength is improved without utilizing such a spring construction. In a high-voltage connector of the kind set forth this object is achieved in accordance with the invention in that the elastomer is made to swell by means of a swelling medium. As a result of the swelling of the elastomer, even the smallest irregularities in the surfaces of the plug member and the receptacle member disappear, so that an electric behavior similar to that in a homogeneous high-voltage isolator, is achieved.

A high-voltage connector of this kind is preferably suitable for use in an X-ray generator. Therefore, such an X-ray generator comprises a) a high-voltage generator comprising at least one high-voltage output with a first receptacle member, b) an X-ray source comprising at least one high-voltage input with a second receptacle member, c) at least one high-voltage cable for connection to the high-voltage input and/or the high-voltage output via a high-voltage connector which consists of a plug member and a receptacle member receiving the plug member, the area of the plug member facing the receptacle member and/or the area of the receptacle member facing the plug member being provided with a layer of an elastomer, the elastomer in accordance with the invention being made to swell by means of a swelling medium.

It is to be noted that EP-OS 477 857 already discloses a high-voltage connector for a high-voltage generator and an X-ray source whose high-voltage outputs and inputs are interconnected via two cables and high-voltage connectors. Each of the high-voltage connectors consists of a plug member and a receptacle member, the inner diameter of the receptacle member being approximately 1 mm larger than the outer diameter of the plug member. The intermediate space is filled with a liquid insulating substance which gels in the course of time. Thus, the high-voltage strength is achieved in that a sufficiently large space between plug member and receptacle member is filled with a liquid insulating medium. In accordance with the invention, however, the high-voltage strength is achieved in that the elastomer is made to swell by means of the swelling medium, which may also be liquid and have insulating properties, in such a manner that no clearance which could influence the high-voltage strength remains between the plug member and the receptacle member.

A method of assembling such a high-voltage connector, offering improved voltage strength and based on a high-voltage connector consisting of a plug member and a receptacle member receiving a plug member, the area of the plug member facing the receptacle member and/or the area of the receptacle member facing the plug member being provided with a layer of an elastomer, is characterized in accordance with the invention in that a medium which acts on the elastomer as a swelling medium is introduced in the joint between the plug member and the receptacle member.

The swelling medium is applied to one of the contacting surfaces of the plug member or the receptacle member preferably immediately prior to assembly of the high-voltage connector. When the plug member and the receptacle member are plugged one into the other, the swelling medium initially acts as a lubricant which facilitates the frictionless assembly of these two parts. During the subsequent swelling process of the elastomer, even the smallest irregularities in the surfaces disappear and the joint between the two parts is completely filled by the swollen elastomer.

The swelling medium may have the form of a liquid or a paste and should have electrically insulating properties. In a further version of the invention, an aliphatic hydrocarbon compound serves as the swelling medium. The shorter the chain of the hydrocarbon compound is, the better the penetration of the swelling medium into the elastomer so as to cause swelling thereof.

The effect also depends on the elastomer used. Elastomers which are suitable for use in this respect are synthetic rubber (for example, silicon rubber), EPR (ethylene propylene rubber), natural rubber as well as thermoplastic elastomers (TPE).

BRIEF DESCRIPTION OF THE DRAWING

The invention will be described in detail hereinafter with reference to the drawing. Therein.

DETAILED DESCRIPTION OF THE PREFERRED EMBODIMENTS

Figure 1:
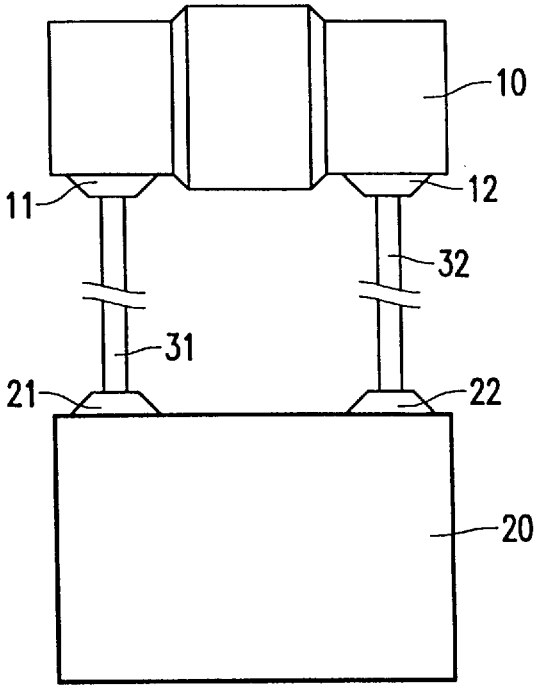
FIG. 1 shows an X-ray generator in accordance with the invention.

The X-ray generator shown in FIG. 1 comprises a high-voltage generator 20 which generates a positive high voltage on a first high-voltage output 21 and a negative high voltage on a second output 22 (in relation to ground). The X-ray generator also comprises an X-ray source 10 which comprises a first high-voltage input 11 for receiving a positive high voltage and a second high-voltage input 12 for receiving a negative high voltage.

The high-voltage output 21 is connected to the high-voltage input 11 via a high-voltage cable 31 whereas the high-voltage output 22 is connected to the high-voltage input 12 via a high-voltage cable 32. The connection between the high-voltage cables and the high-voltage input and output is realised via respective high-voltage connector, one of which is shown in FIG. 2.

Figure 2:
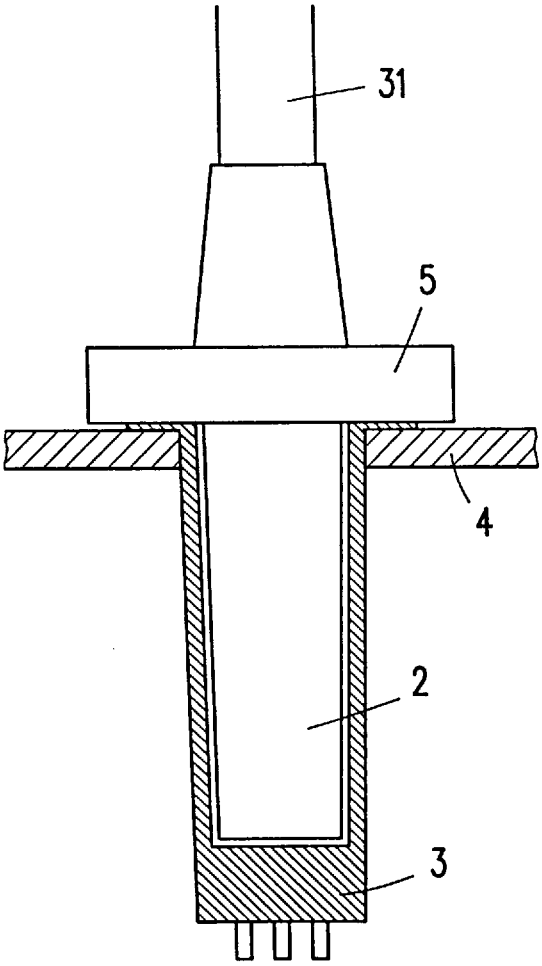
FIG. 2 shows a high-voltage connector in accordance with the invention.

As appears from FIG. 2, the high-voltage cable 31 terminates in a high-voltage plug member 2. The plug member 2 is made of silicon rubber, at least as far as its exterior region is concerned. However, it may alternatively consist of another elastomer, for example a thermoplastic synthetic material or a polyurethane elastomer. In the assembled condition the plug member 2 is received by a receptacle member 3 which may consist of a hard insulating material, for example epoxy resin, PET or PBT. The receptacle member 3 is secured, for example to the lid of the high-voltage generator 20, which is not shown herein, and the plug member 2 is pressed into the receptacle member by way of a coupling nut 5 which engages a thread at the upper end of the receptacle member. At least the side faces of the plug member 2 consist of silicon rubber.

Prior to the introduction of the plug member 2, it is immersed in transformer oil, for example as used in high-voltage generators for insulation purposes, and subsequently the plug member 2 is introduced into the receptacle member 3 so as to be connected thereto by tightening of the coupling nut 5. (It is also possible to apply some transformer oil to the receptacle member, followed by insertion of the plug member so that the transformer oil spreads through the joint.) The transformer oil facilitates the introduction of the plug member and subsequently ensures the swelling of the silicon rubber. The latter is, therefore, laterally pressed against the receptacle member 3, so that the joint is fully filled and sealed. Therefore, the latter has substantially the same insulating properties as the homogeneous insulating material (silicon rubber).

A high-voltage connector thus formed with a plug member length of 55 mm was found to offer adequate high-voltage strength for operation with 75 kV.

I claim:

1. A high-voltage connector, comprising a plug member and a receptacle member in which the plug member has been received so that facing surfaces of the plug member and the receptacle member are in physical contact along a joint, at least one of the surface of the plug member facing the receptacle member and the surface of the receptacle member facing the plug member being provided with a layer of an elastomer, wherein the elastomer has been made to swell along said joint after the plug member has been received in the receptacle member by applying a swelling medium thereto substantially immediately prior to the plug member being received in the receptacle member.

2. An X-ray generator, comprising:

a) a high-voltage generator comprising at least one high-voltage output with a first receptacle member, b) an X-ray source comprising at least one high-voltage input with a second receptacle member, c) at least one high-voltage cable for connection to at least one of the high-voltage input and the high-voltage output via a high-voltage connector which comprises a plug member and a receptacle member in which the plug member has been received so that facing surfaces of the plug member and the receptacle member are in physical contact along a joint, at least one of the surface of the plug member facing the receptacle member and the surface of the receptacle member facing the plug member being provided with a layer of an elastomer, wherein the elastomer has been made to swell along said joint after the plug member has been inserted in the receptacle member by applying a swelling medium thereto substantially immediately prior to the plug member being received in the receptacle member.

3. A method of assembling a high-voltage connector which comprises a plug member and a receptacle member for receiving the plug member so that facing surfaces of the plug member and the receptacle member are in physical contact along a joint, at least one of the surface of the plug member facing the receptacle member and the surface of the receptacle member facing the plug member being provided with a layer of an elastomer, which method comprises applying a swelling medium to the elastomer, and substantially immediately thereafter causing the plug member to be received in the receptacle member such that the elastomer is made to swell along said joint after the plug member has been received in the receptacle member.

4. A method as claimed in claim 3, wherein an aliphatic hydrocarbon compound is the swelling medium.

5. A method as claimed in claim 3, wherein transformer oil is the swelling medium.

6. A high-voltage connector as claimed in claim 1, wherein an aliphatic hydrocarbon compound is the swelling medium.

7. A high-voltage connector as claimed in claim 1, wherein transformer oil is the swelling medium.

8. An X-ray generator as claimed in claim 2, wherein an aliphatic hydrocarbon compound is the swelling medium.

9. An X-ray generator as claimed in claim 2, wherein transformer oil is the swelling medium.

* * * * *